United States Patent [19]

Daugherty et al.

[11] Patent Number: 4,978,485

[45] Date of Patent: Dec. 18, 1990

[54] METHOD FOR CONTROLLING A QUENCH FLUID VELOCITY IN A POLYMER MELT SPINNING PROCESS

[75] Inventors: Paul R. Daugherty, Seabrook, Tex.; Jerry R. McNair; Patrick F. O'Donnell, both of Stone Mountain, Ga.

[73] Assignee: Amoco Corporation, Chicago, Ill.

[21] Appl. No.: 223,909

[22] Filed: Jul. 25, 1988

[51] Int. Cl.[5] ..... D01D 5/088

[52] U.S. Cl. ..... 264/40.2; 264/40.6; 264/211.14; 73/861.85

[58] Field of Search ..... 73/861.85, 522, 515, 73/159, 160; 264/40.1, 40.6, 205, 211.14; 425/72.2, 135

[56] References Cited

U.S. PATENT DOCUMENTS

| | | | |
|---|---|---|---|
| 2,041,862 | 5/1936 | Rhodes | 137/486 |
| 2,662,547 | 12/1953 | Comeau | 137/486 |
| 4,204,828 | 5/1980 | Peckinpaugh et al. | 425/72.2 |
| 4,377,540 | 3/1983 | Cluett et al. | 264/23 |
| 4,449,664 | 5/1984 | Mithuhira et al. | 236/49 |

*Primary Examiner*—Hubert C. Lorin

*Attorney, Agent, or Firm*—Robert G. Ladd; William H. Magidson; Ralph C. Medhurst

[57] ABSTRACT

A method for controlling a quench fluid velocity delivered to a quench zone in a polymer melt spinning process wherein the quench fluid velocity is measured by a velocity detector, compared to a desired quench air velocity and a damper valve mechanism is adjusted in a quench fluid duct so that the desired quench fluid velocity is obtained.

6 Claims, 3 Drawing Sheets

METHOD FOR CONTROLLING A QUENCH FLUID VELOCITY IN A POLYMER MELT SPINNING PROCESS

FIELD OF THE INVENTION

This invention relates to a method and an apparatus for controlling a quench fluid stream velocity delivered to a quench zone in a polymer melt spinning process.

BACKGROUND OF THE INVENTION

In polymer melt spinning processes, polymer melt is supplied to a spinneret having numerous holes through which the melted polymer is extruded to form multiple polymer filaments which are drawn and taken up or wound onto a suitable means for receiving polymer filaments after the polymer filaments have been cooled. A quench fluid is directed across the path of the polymer filaments to cool them while they pass through a quench zone in the melt spinning process. Typically, the quench fluid is a quench air stream produced by chilling ambient air and blowing the quench air stream across the polymer filaments as they issue from the spinneret. For polymer filaments which are susceptible to degradation by contact with oxygen, inert fluids such as nitrogen may be used. The polymer filaments are protected from stray drafts by enclosing them in a protective chimney termed a quench zone or quench air cabinet until close to the point where the filaments converge to form a yarn or small tow.

Currently, several methods are used to set the quench fluid stream velocity in the quench zone of polymer melt spinning processes. One method involves two operators with a first operator measuring the quench fluid stream velocity with a hand held velometer and a second operator positioned at a quench fluid damper valve to make adjustments to the damper valve under direction of the first operator. Achieving accurate and reproducible quench fluid velocities using this method is cumbersome and time consuming, and operators must often shout above loud machinery noise. An even slower method involves a single operator who measures the quench fluid velocity and then adjusts the quench fluid damper valve. Through successive travels between the quench fluid damper valve and the velocity measurement location, with adjustments of the quench fluid damper valve, the desired quench fluid velocity is obtained. This method is time consuming especially if the damper valve and velocity measurement location are located on different floors of the polymer melt spinning process. Another method used for setting the quench fluid velocity is to measure the pressure behind the damper valve and to set the quench fluid velocity according to relative pressure drops. Clearly, for quick, accurate and repeatable setting of quench fluid velocities, the above methods are not acceptable.

U.S. Pat. No. 2,041,86 describes a means for stopping flow to a break or a serious leak in a fluid line by automative valves which may be opened and closed by manual control or remote control of a motor.

U.S. Pat. No. 2,662,547 describes an apparatus for automatically controlling the flow of air to the cabin of an aircraft in which the rotation of a butterfly valve is controlled by using a worm wheel sector and worm driven by a reversible motor.

U.S. Pat. No. 4,449,664 describes an air quantity regulating apparatus for air conditioning wherein an air quantity detector detects the quantity of air flowing through a duct member and delivers this information to a control mechanism to control a driving mechanism which uses a reversible driving motor, worm gear and worm wheel to drive a throttle valve which is intended to restrict the flow of air through the duct member.

The patents described above do not address polymer melt spinning processes or the need for quick, accurate and repeatable control of the quench fluid velocity used to cool the polymer filaments produced in the melt spinning process. Persons skilled in the art of melt spinning polymers would not look to these patents for a method and an apparatus for controlling a quench fluid stream velocity delivered to a quench zone in a polymer melt spinning process.

Many melt-spinning processes based on solid polymer resin melt the polymer resin with screw extruders fed directly with polymer in powdered or pellet form. A single extruder may supply several spinning positions through a series of branching pipes or tubes. The manifold leading from the extruder usually is designed in such a way as to minimize path lengths and differences in thermal history and residence time between the molten polymer supplied to the different spinning positions.

Many polyamide and polyester fiber plants are based upon continuous melt polymerization and in these plants the polymer is usually not solidified before spinning. Instead, the product is fed directly through a manifold from the polymerization plant to the spinning unit.

Whichever source of molten polymer is employed, the feed rate to individual spinning units is controlled by an accurately machined metering gear pump capable of feeding polymer against high back pressure and which delivers molten polymer at a constant rate into a filter assembly. The molten polymer is filtered through a series of sintered or fibrous metal gauzes or a bed of graded fine refractory material, such as sand or alumina, held in place by metal screens. Filtration removes large solid or gel particles that might otherwise block spinneret holes or, if passed through, occupy sufficient cross-sectional area in the polymer filament to affect its processing or tensile properties.

After filtration, the molten polymer passes to the spinneret through a short distribution system arranged to maximize mixing, equalize temperature, and minimize stagnancy. Dynamic mixers, static mixers, or flow inverters are sometimes included, for instance, in the manifold to improve the homogeneity of the molten polymer before the spinning positions.

Spinnerets for continuous-filament yarn production may have up to about 500 holes, most commonly 40 to 200, and those for tow may have several thousand. The holes and resulting filaments from a single continuous-filament spinning position may be divided into groups, e.g., a 50-hole spinneret may be used to produce two 25-filament yarns. As molten polymer passes through a spinneret hole, it is drawn and attenuated by a drawdown force applied by a windup roll or winder; simultaneously the temperature of the filaments rapidly decreases. The diameter of the polymer filament immediately below the spinneret hole and before attenuation begins is larger than the hole diameter. This phenomenon is termed die swell and is due to relaxation of the viscoelastic stress induced in the polymer filament as it is extruded through the spinneret hole. When spinning oxidation-sensitive polymers, it is useful to blanket a narrow zone immediately below the spinneret with inert gas in order to prevent deposition of degradation products around the orifices. A short cylindrical cowl, known as a shroud, extending downward for a short distance around the space immediately below the spinneret, maintains a blanket of hot gas around the nascent thread line and is used particularly where a spun yarn of low orientation but high orientability is required, as in the production of high tenacity yarns.

Immediately below this region, cool filtered air termed quench air is blown across the polymer filaments to promote uniform cooling. The quench air can be directed across the path of the filaments (crossflow quench), radially inward (inflow quench), or radially outward (outward quench).

SUMMARY OF THE INVENTION

The present invention relates to a method for controlling a quench fluid stream velocity delivered to a quench zone in a polymer melt spinning process and to a melt spinning apparatus for carrying out such a method. The quench fluid velocity is measured by a velocity detector, compared to a desired quench fluid stream velocity and a damper valve mechanism in a quench fluid duct is adjusted so that desired quench fluid stream velocity is obtained.

DETAILED DESCRIPTION OF THE PREFERRED EMBODIMENTS

Figure 1:
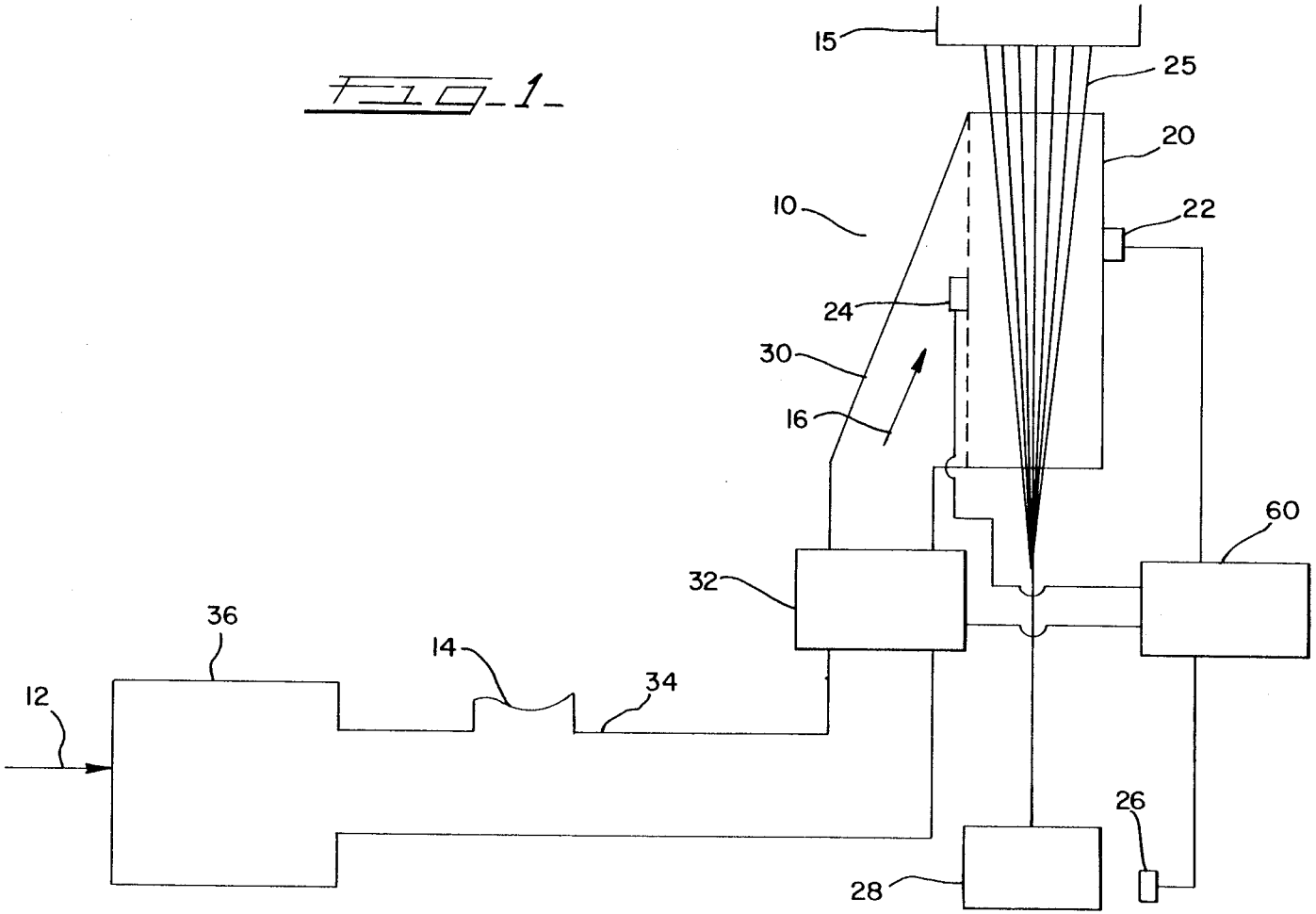
FIG. 1 is a diagrammatic representation of the melt spinning process and damper valve control mechanism embodying the method and apparatus of the present invention.

This invention relates to a method and an apparatus for controlling a quench fluid stream velocity flowing across polymer filaments in a polymer melt spinning process and enables the velocity of quench fluid to be measured and controlled more quickly, accurately and repeatably than by existing methods. The polymer is selected from the group consisting of polyolefin, polyamide and polyester. The method and apparatus of this invention utilizes a vane anemometer to measure the quench fluid velocity; a damper valve mechanism to regulate the volume of quench fluid delivered to a quench zone through a quench fluid duct; and a process controller to control the damper valve mechanism in order to obtain a desired quench fluid velocity in one or more quench zones which are supplied quench fluid from a quench fluid delivery system. Either manual control or automatic process control of the damper valve mechanism is contemplated. The damper valve mechanism has a driving mechanism comprising an alternating current bi-rotational reduction motor, a worm gear and a worm wheel to produce a relatively low rpm output to drive a damper valve shaft. The rpm output can range from about 0.1 rpm to about 2 rpm with 0.5 rpm being a typical value. A damper valve plate is pivotally supported in a quench fluid duct and is fixed to the damper valve shaft so that as the damper valve shaft is rotated the damper valve plate can be moved from a closed position to an open position in the quench fluid duct.

A single-pole double-throw spring-return-to-center-off switch is used to operate the motor to adjust the damper valve mechanism manually. For manual control of the damper valve mechanism, one or more of the switches described above may be located remotely from the motor. Typically, one switch is located by the quench zone near the quench air velocity measuring location. An operator holds a portable velometer with one hand and observes the measured quench fluid velocity while adjusting the damper valve by using the remote switch with the other hand. A second switch is located near the polymer filament take-up means and an operator can obtain the quench fluid velocity from a digital readout supplied to the melt spinning process control board by a vane anemometer mounted directly behind the inlet screen of the quench zone which is at the outlet of the quench fluid duct. A second digital readout may also be located near the remote switch located by the quench zone.

A damper valve mechanism is mounted in the ductwork leading to each quench zone. Each line has two remote mechanism control switches with one mounted on the quench cabinet and the other mounted near the polymer filament take-up means for use on manual control. Each line has a vane anemometer to supply the quench stream fluid stream velocity tied to two digital readout meters. Each of the meters is mounted near one of the two damper valve mechanism control switches.

An additional damper valve mechanism control switch may be located near the damper valve mechanism to check the location of the damper valve when adjusting the damper valve to fully-open or to fully-closed positions. On some damper valves, complete rotation is not possible, and any attempts to do so would result in damage to the damper valve. An alternative to using a separate switch located near the damper valve is to use normally-closed limit switches which enable an operator to fully close or fully open the damper without visually inspecting the rotational location of the damper.

Advantages of the apparatus and the process employing the apparatus of this invention include reducing the time required to set the quench fluid velocity from five minutes using two operators to less than fifteen seconds using one operator on manual control. On automatic closed loop control essentially instantaneous setting of the quench fluid velocity is anticipated. One additional advantage in using the motorized damper control is that variations in quench fluid velocity due to a slight rotation of the damper shaft are eliminated. Previously, the damper shaft and adjustment lever were not rigidly connected and a slight rotational play was experienced which caused fluctuations in the velocity of the quench fluid. In addition, this rotational play caused a ramming effect on the adjustment lever, and even though the lever was tightened down with a wing nut, successive rammings between the damper valve shaft and adjustment lever caused the damper valve to drift towards a fully-open position. The motor used in this apparatus has a torque of 60 inch-pounds eliminating nearly all rotational play and drift.

Referring now to the drawing of FIG. 1, reference number 10 designates a polymer melt spinning process. Molten polymer is delivered to and melt spun through a spinneret 15. Polymer filaments 25 are melt spun through spinneret 15, pass through a quench cabinet or quench zone 20 and are wound on a polymer filament take-up means 28. Polymer filament take-up means 28 can be a winder, a take-up roll or other means commonly used in polymer melt spinning processes.

Ambient air or other fluid from stream 12 is chilled to the desired temperature and blown into a quench fluid delivery system 34 by an air chiller and blower system 36. The blower of system 36 remains on at all times and blows the air at a single constant rate into the quench fluid delivery system 34.

The quench fluid delivery system 34 delivers quench fluid to quench zone 20 via a quench fluid duct 30. A separate quench fluid duct 14 is used to deliver quench fluid to a separate melt spinning line (not shown). The quench fluid velocity delivered to quench zone 20 is measured by a quench fluid velocity detector 24. The quench fluid velocity is controlled by a damper valve control mechanism 32. A damper valve control mechanism switch 22 is located on quench zone 20 and a second remote damper valve control mechanism switch 26 is located near the polymer filament take-up means 28.

The driving mechanism 38 is controlled by a process controller 60. The process controller 60 receives a signal corresponding to the quench fluid velocity in the quench zone 20 from the quench fluid velocity detector 24 and compares the quench air velocity with a desired quench fluid velocity. If the quench air velocity is less than the desired quench fluid velocity then process controller 60 sends a signal to activate the bi-rotational reduction motor to rotate damper plate 46 in such a manner that an increased quench fluid velocity is obtained. If the measured quench fluid velocity is greater than the desired quench fluid velocity, a signal is sent by process controller 60 to activate motor 50 to rotate damper plate 46 in such a manner that less quench fluid is sent to the quench zone 20 and the desired quench fluid velocity is obtained.

Figure 3:
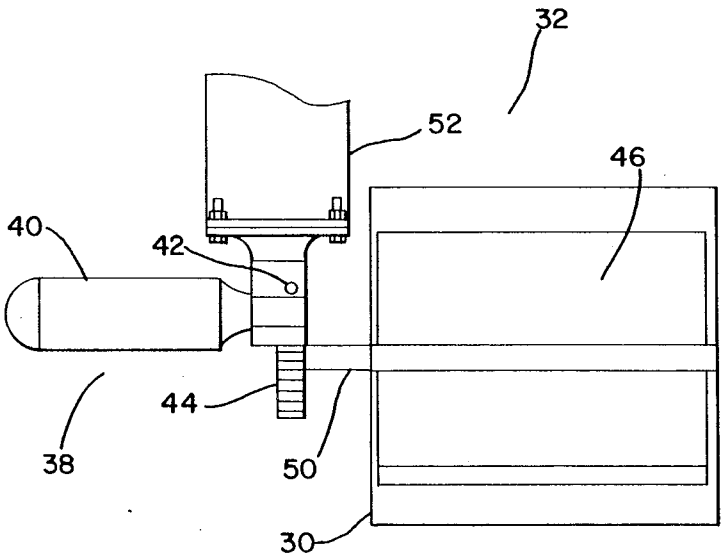
FIG. 3 is a partial perspective front view of the damper valve mechanism.
Figure 2:
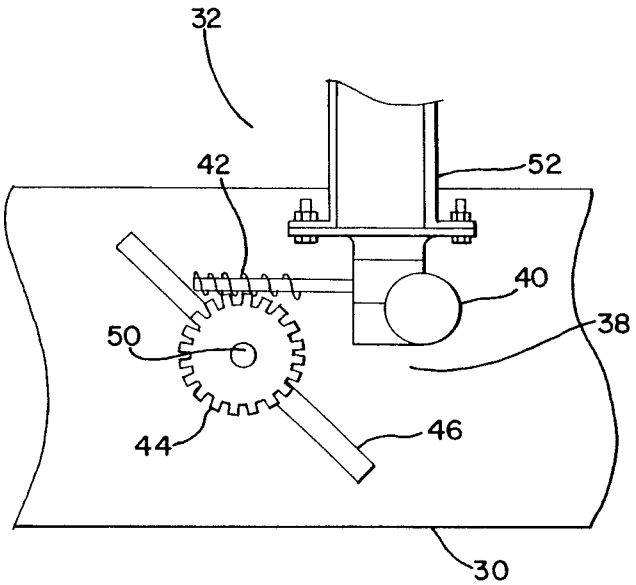
FIG. 2 is a partial perspective side view of the damper valve mechanism.

One embodiment of the damper valve control mechanism 32 is shown in partial perspective side view in FIG. 2 and partial perspective front view in FIG. 3. A damper valve mechanism support 52 supports damper valve control mechanism 32 in the quench fluid duct 30. Damper valve control mechanism 32 comprises a damper valve shaft 50 disposed in the quench fluid duct 30 and has a damper plate 46 attached to damper valve shaft 50 such that damper valve shaft 50 can rotate damper plate 46 from a closed position to an open position to allow the quench fluid to flow to the quench zone 20. The damper valve shaft 50 is driven by a driving mechanism 38.

The driving mechanism 38 as illustrated in FIGS. 2 and 3 for driving damper valve shaft 50 is provided with a bi-rotational reduction motor 40 with a worm gear 42 fixed to motor 40. Worm gear 42 is in mesh with a worm wheel 44 and the rotating axis of worm wheel 44 is at a right angle to that of worm gear 42 and is aligned with the damper valve shaft 50.

Figure 4:
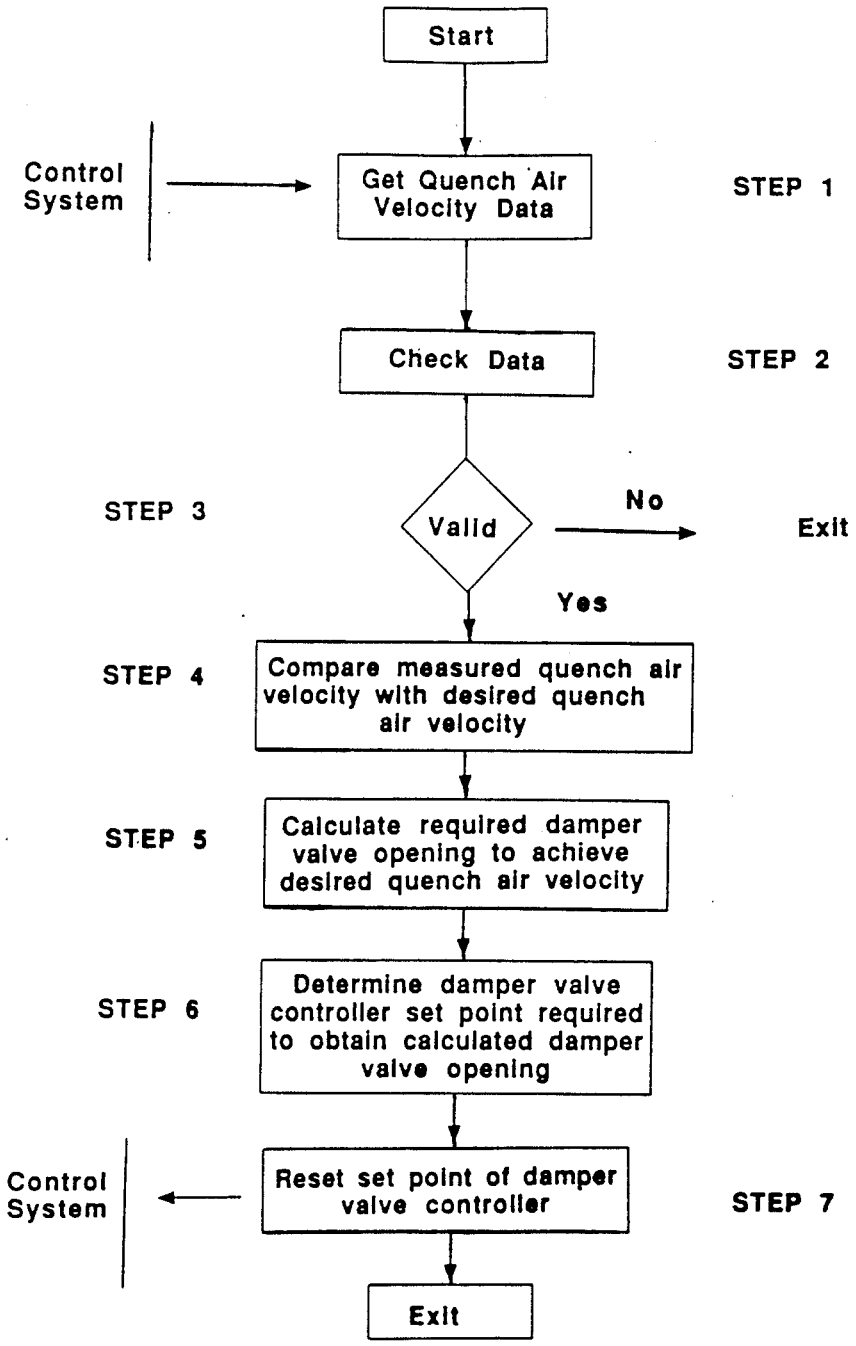
FIG. 4 is a flow chart of the program or routine carried out by the process controller for controlling the quench fluid stream velocity delivered to the quench zone.

From FIG. 4, process controller 60 follows the following routine to control the quench fluid velocity:

At STEP 1, obtain the quench fluid velocity data.

At STEP 2, check the quench fluid velocity data.

At STEP 3, determine whether or not the quench fluid velocity data is valid. If the quench fluid velocity data is not valid, exit. If the quench fluid velocity data is valid, go to STEP 4.

At STEP 4, compare the measured quench fluid velocity with a desired quench fluid velocity.

At STEP 5, calculate a required damper valve opening to achieve the desired quench fluid velocity.

At STEP 6, determine a damper valve set point required to obtain the calculated damper valve opening.

At STEP 7, reset the damper valve set point required to obtain the desired quench fluid velocity.

Then the program exits and starts over at a predetermined time sequence.

Anemometers which can be used in the method and apparatus of this invention include the following: a hot-wire, constant-temperature anemometer such as a Model 1640 Air Velocity Meter of TSI Incorporated, 500 Cardigan Road, St. Paul, Minn., 55164 and a Model 870A400-275 Vane Anemometer of Mitchell Instruments, 1570 Cherokee St., San Marcos, Calif., 92069.

It is to be understood that this invention is not limited to the above-mentioned embodiment, and that various changes and modifications may be effected therein by one skilled in the art without departing from the scope or spirit of the invention.

The driving mechanism 38 is not limited to the illustrated one, but may be any other suitable mechanism which can open and close the damper plate 46.

Furthermore, the damper plate 46, which rotates to open and close the passage in quench fluid duct 34 is order to control the quench fluid velocity, may be replaced with a damper or throttle valve which opens and closes the passage by linear motions.

We claim:

1. A method for controlling a quench fluid velocity in a polymer melt spinning process comprising:

(a) melt spinning a plurality of polymer filaments through a spinneret into a quench fluid zone;

(b) introducing a quench fluid stream from a quench fluid delivery system into the quench fluid zone to cool the polymer filaments;

(c) measuring a velocity of the quench fluid stream with an anemometer;

(d) controlling a damper valve drive mechanism which includes an alternating current bi-rotational reduction motor having a worm gear fixed to the motor and in mesh with a worm wheel fixed to a damper valve shaft with the rotating axis of the worm wheel at a right angle to that of the worm gear and aligned with the damper valve shaft in the quench fluid delivery system based on the measured quench fluid stream velocity to obtain a desired velocity of the quench fluid stream; and (e) winding the polymer filaments onto a polymer filament receiving means.

2. The method according to claim 1, wherein said melt spinning of polymer filaments is accomplished by using at least one polymer selected from the group consisting of polyolefin, polyamide and polyester.

3. The method according to claim 1, wherein said anemometer includes a portable hot-wire, constant-temperature anemometer.

4. The method according to claim 3, wherein said controlling of the damper valve drive mechanism includes manually operating one or more switches, said switches being remotely located from the damper valve drive mechanism.

5. The method according to claim 1, wherein said anemometer includes a fixed vane type anemometer.

6. The method according to claim 5, wherein said controlling of the damper valve drive mechanism includes a process controller to automatically control the damper valve drive mechanism.

* * * * *